US006651858B2

(12) United States Patent
Shen

(10) Patent No.: US 6,651,858 B2
(45) Date of Patent: Nov. 25, 2003

(54) ADJUSTABLE WRAPPAGE FILM FEEDING DEVICE

(75) Inventor: Ying Liang Shen, Taipei (TW)

(73) Assignee: Benison & Co., Ltd., Taipei (TW)

( * ) Notice: Subject to any disclaimer, the term of this patent is extended or adjusted under 35 U.S.C. 154(b) by 62 days.

(21) Appl. No.: 09/982,802

(22) Filed: Oct. 22, 2001

(65) Prior Publication Data

US 2003/0075581 A1 Apr. 24, 2003

(51) Int. Cl.[7] ..... B65H 20/00; B65B 9/06; B31B 49/04

(52) U.S. Cl. ..... 226/176; 53/551; 226/188; 493/196

(58) Field of Search ..... 226/156, 176, 226/177, 179, 188, 189; 53/551; 493/180, 196, 478, 479

(56) References Cited

U.S. PATENT DOCUMENTS 3,052,393 A * 9/1962 McKenzie ..... 226/177
3,583,620 A * 6/1971 Postins ..... 226/172
3,653,569 A * 4/1972 Homstead et al. ..... 226/179
4,136,505 A * 1/1979 Putnam et al. ..... 53/551
4,691,499 A * 9/1987 Umeda et al. ..... 53/551
4,840,012 A * 6/1989 Boeckmann ..... 226/172
5,027,584 A * 7/1991 McMahon et al. ..... 226/179
5,125,217 A * 6/1992 Fukuda ..... 53/551
6,041,991 A * 3/2000 Mehri et al. ..... 226/177
6,200,249 B1 * 3/2001 Fukuda ..... 53/551

* cited by examiner

*Primary Examiner*—Michael R. Mansen
(74) *Attorney, Agent, or Firm*—Rosenberg, Klein & Lee

(57) ABSTRACT

An adjustable wrappage film feeding device includes a chassis having end plates rotatably supporting a driving shaft therebetween. The driving shaft is driven by a motor via a worm—worm gear transmission. Two first bevel gears are mounted on the driving shaft to be rotatable in unison with the driving shaft while being allowed to axially move with respect to the driving shaft. A screw rod is rotatably supported by the end plates and threadingly engages two movable carriages that are spaced from each other a distance. By rotating the screw rod, the carriages are driven toward/away from each other and thus changing the distance therebetween. Each carriage rotatably carries a roller adapted to drivingly engage and convey a film in a predetermined direction toward an article to be packaged. Each roller is coupled to a corresponding one of the first bevel gears by a second bevel gear that mates the corresponding first bevel gear. The change of distance between the carriages allows accommodation of film of different sizes. The axial movability of the first bevel gears with respect to the driving shaft maintains mating engagement between the first and second bevel gears when the carriages are moved by the screw rod.

9 Claims, 9 Drawing Sheets

ADJUSTABLE WRAPPAGE FILM FEEDING DEVICE

FIELD OF THE INVENTION

The present invention generally relates to a film wrapping machine for wrapping articles with heat-shrinkage synthetic films, and in particular to an adjustable film feeding device capable to accommodate films of different size for wrapping articles of different sizes.

BACKGROUND OF THE INVENTION

Heat shrinkage films are widely used to package articles or consumer products, such as CDs (Compact Disks). The packaging is done by placing a tubular film over the article to be packaged. One way to fit the tubular film over the article is to first place the tubular film over a film feeding cylinder with the article positioned below the film feeding cylinder. Rollers are then positioned in physical contact with the film feeding cylinder for frictionally driving the tubular film downward and fitting over the article.

A complicated transmission/driving mechanism is required to control the operation of the rollers for manipulation of the moving speed of the tubular film toward the article. Such a complicated mechanism makes it difficult to change the spatial relationship of the rollers with respect to the film feeding cylinder. Thus re-arrangement of the rollers with respect to the film feeding cylinder for accommodating films of different sizes for packaging different articles cannot be done without replacing the original transmission/driving mechanism with one of different specification or without re-designing the transmission/driving mechanism. Cost can thus be increased and shutdown time of the packaging machine may be undesirably extended in changing or rearranging the transmission/driving mechanism.

It is thus desirable to provide an adjustable wrappage film feeding device for alleviating the above-discussed problems.

SUMMARY OF THE INVENTION

Accordingly, an object of the present invention is to provide an adjustable wrappage film feeding device comprising location-adjustable film feeding rollers for accommodating films of different sizes.

Another object of the present invention is to provide an adjustable wrappage film feeding device wherein adjustment for accommodating films of different sizes can be done with simple and efficient operations thereby reducing shutdown time.

A further object of the present invention is to provide an adjustable wrappage film feeding device which allows films of different sizes without replacement of transmission mechanism.

Yet a further object of the present invention is to provide an adjustable wrappage film feeding device which allows films of different sizes without re-designing transmission mechanism.

In accordance with the present invention, an adjustable wrappage film feeding device comprises a chassis having end plates rotatably supporting a driving shaft therebetween. The driving shaft is driven by a motor via a worm—worm gear transmission. Two first bevel gears are mounted on the driving shaft to be rotatable in unison with the driving shaft while being allowed to axially move with respect to the driving shaft. A screw rod is rotatably supported by the end plates and threadingly engages two movable carriages that are spaced from each other a distance. By rotating the screw rod, the carriages are driven toward/away from each other and thus changing the distance therebetween. Each carriage rotatably carries a roller adapted to drivingly engage and convey a film in a predetermined direction toward an article to be packaged. Each roller is coupled to a corresponding one of the first bevel gears by a second bevel gear that mates the corresponding first bevel gear. The change of distance between the carriages allows accommodation of film of different sizes. The axial movability of the first bevel gears with respect to the driving shaft maintains mating engagement between the first and second bevel gears when the carriages are moved by the screw rod.

BRIEF DESCRIPTION OF THE DRAWING

The present invention will be apparent to those skilled in the art by reading the following description of preferred embodiments thereof, with reference to the drawings, wherein.

DETAILED DESCRIPTION OF THE PREFERRED EMBODIMENTS

Figure 1:
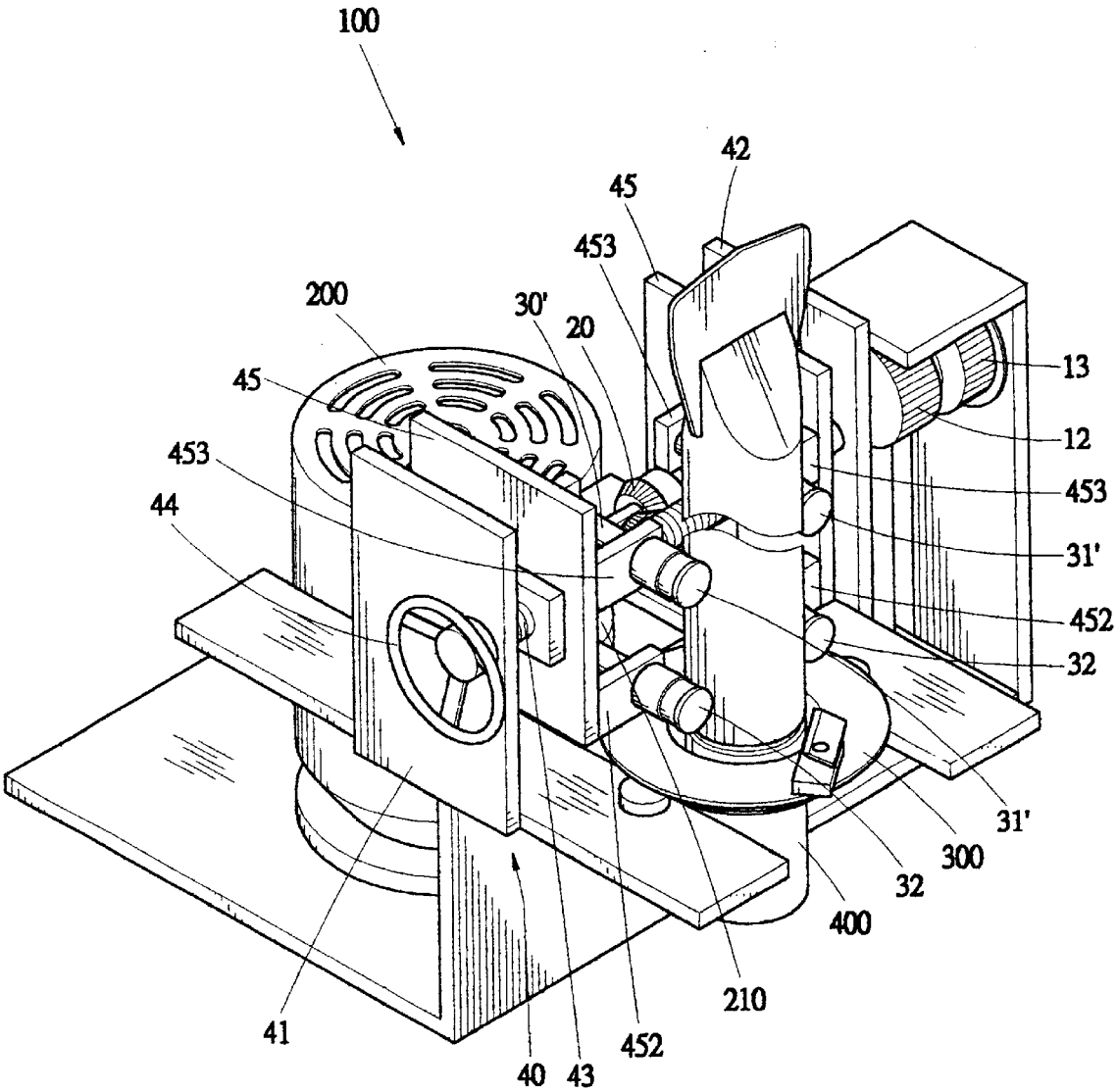
FIG. 1 is a perspective view of an adjustable wrappage film feeding device constructed in accordance with a first embodiment of the present invention.
Figure 2:
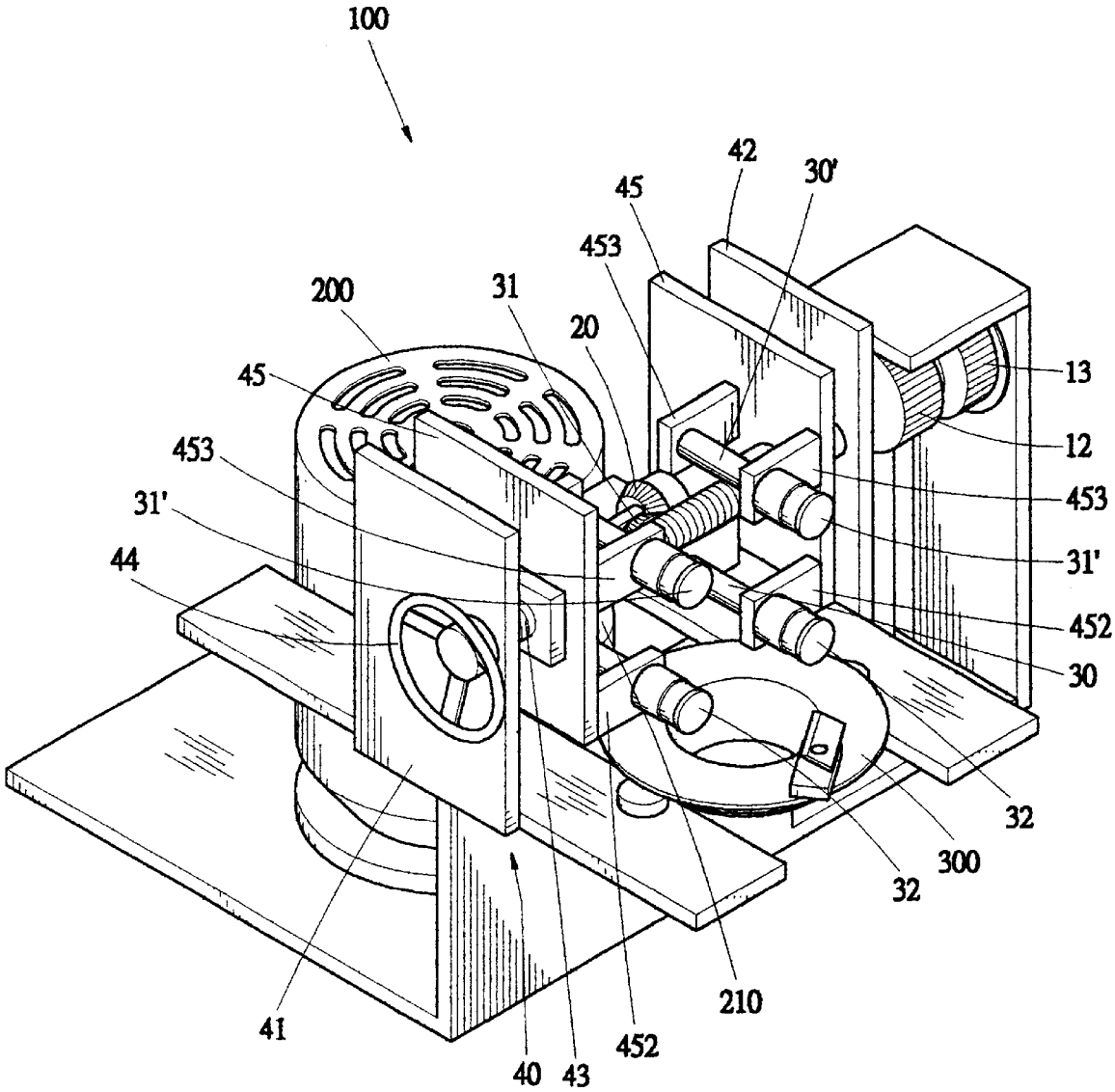
FIG. 2 is similar to FIG. 1 with a film feeding cylinder removed.
Figure 3:
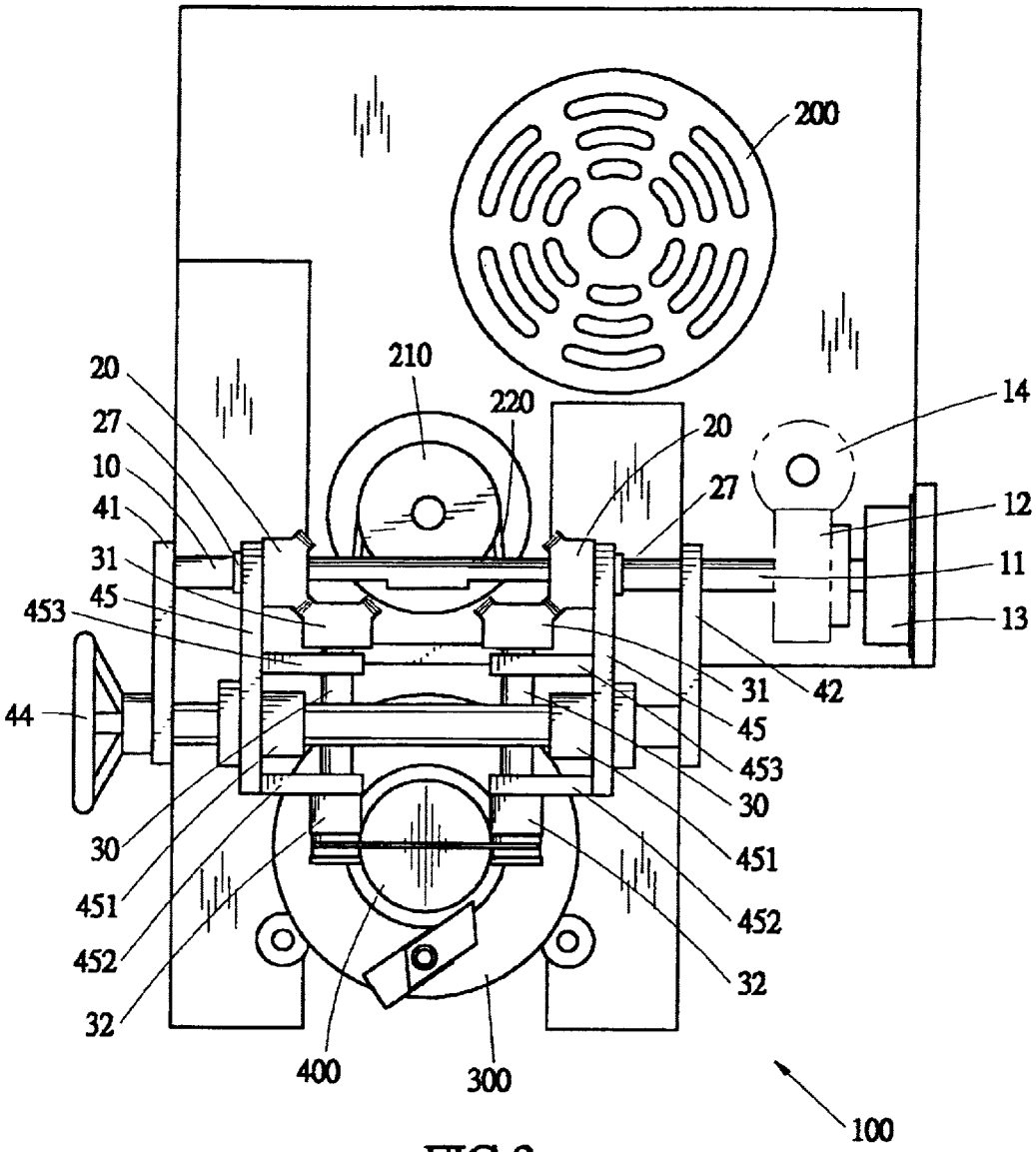
FIG. 3 is a top view of FIG. 1.

With reference to the drawings and in particular to FIGS. 1–3, a wrappage film feeding device constructed in accordance with the present invention, generally designated with reference numeral 100, comprises a driving shaft 10 mechanically coupled to a driving device 200, such as a motor, via a worm—worm gear transmission including a worm gear 12 mounted on a shaft 11 disengageably coupled to the driving shaft 10 and a worm 14 driven by the driving device 200. A clutch 13 is provided between the driving shaft 10 and the worm—worm gear transmission for controlling engagement/disengagement of the driving shaft 10 with/from the driving device 200 thus controlling the operation of the driving shaft 10.

The wrappage film feeding device 100 comprises a film cutting mechanism 300 which is driven by the driving device 200 via a belt transmission 220. A second clutch 210 is arranged between the belt transmission 220 and the driving device 200 for controlling the operation of the film cutting mechanism 300. The film cutting mechanism 300 itself may be any known film cutting device and constitutes no novel part of the present invention. Thus, details of the film cutting mechanism 300 will not be described herein.

The clutches 13, 210 are arranged so that they are electrically associated with each other and are not allowed to be activated at the same time. In other words, when the clutch 13 is in an engaged condition, causing driving shaft 10 to rotate with the driving device 200, the clutch 210 is set to a disengaged condition to separate the film cutting mechanism 300 from the driving device 200 whereby the film cutting mechanism 300 is deactivated when a wrappage film is being fed through the wrappage film feeding device 100 to package an article (not shown). On the other hand, when the film is to be cut off, the operation of the driving shaft 10 is temporarily halted and the film cutting mechanism 300 is activated to cut off the film.

The wrappage film feeding device 100 comprises a film feeding cylinder 400. A tubular film supplied from a film supply source (not shown) is continuously supplied to the film feeding cylinder 400. The tubular film is expanded by and fit over the film feeding cylinder 400. With the aid of film driving rollers 32 mechanically coupled to the driving shaft 10, the film is moved along the film feeding cylinder 400 toward the article to be packaged. Once the article is completely covered by the film, the operation of the driving shaft 10 is stopped by means of the clutch 13 and the movement of the film stopped. The film cutting mechanism 300 is activated to cut off the film. The article is then removed from the wrappage film feeding device 100 for further processing, if necessary.

The wrappage film feeding device 100 comprises an adjustable mechanism 40 comprising two fixed support plates 41, 42 fixed to a machine chassis (not labeled) of the wrappage film feeding device 100 and arranged on opposite sides of the film feeding cylinder 400 for rotatably supporting the driving shaft 10. A screw rod 43 is also rotatably supported by and between the fixed plates 41, 42. A hand wheel 44 is provided outside the fixed plate 41 for manually operating the screw rod 43. Two movable carriages 45 are arranged between the fixed plates 41, 42 and on opposite sides of the film feeding cylinder 400. Each movable carriage 45 forms an inner-threaded hub 451 for threadingly engaging the screw rod 43 whereby rotation of the screw rod 43 causes the carriages 45 to axially move along the screw rod 43 for approaching/moving away from each other.

Each carriage 45 forms spaced lugs 452 rotatably supporting a shaft 30. Each shaft 30 has a first end extending beyond the lug 452 with a film driving roller 32 attached thereto. The film driving rollers 32 are located on opposite sides of the film feeding cylinder 400 for frictional and thus driving engagement with the film fit over the cylinder 400. The distance between the rollers 32 is adjustable by rotating the screw rod 43 to move the carriages 45 toward/away from each other. The adjustability of the distance between the rollers 32 allows the film feeding cylinder 400 to be replaced by one of different size for accommodating films and articles to be packaged of different sizes.

Each shaft 30 of the film driving roller 32 is coupled to the driving shaft 10 by a gear set which in the embodiment illustrated includes a pair of mated bevel gears 20, 31. The gear 20, serving as a driving gear, is axially movably mounted on the driving shaft 10, while the gear 31, serving as a driven gear, is attached to a second end of the shaft 30.

Figure 4:
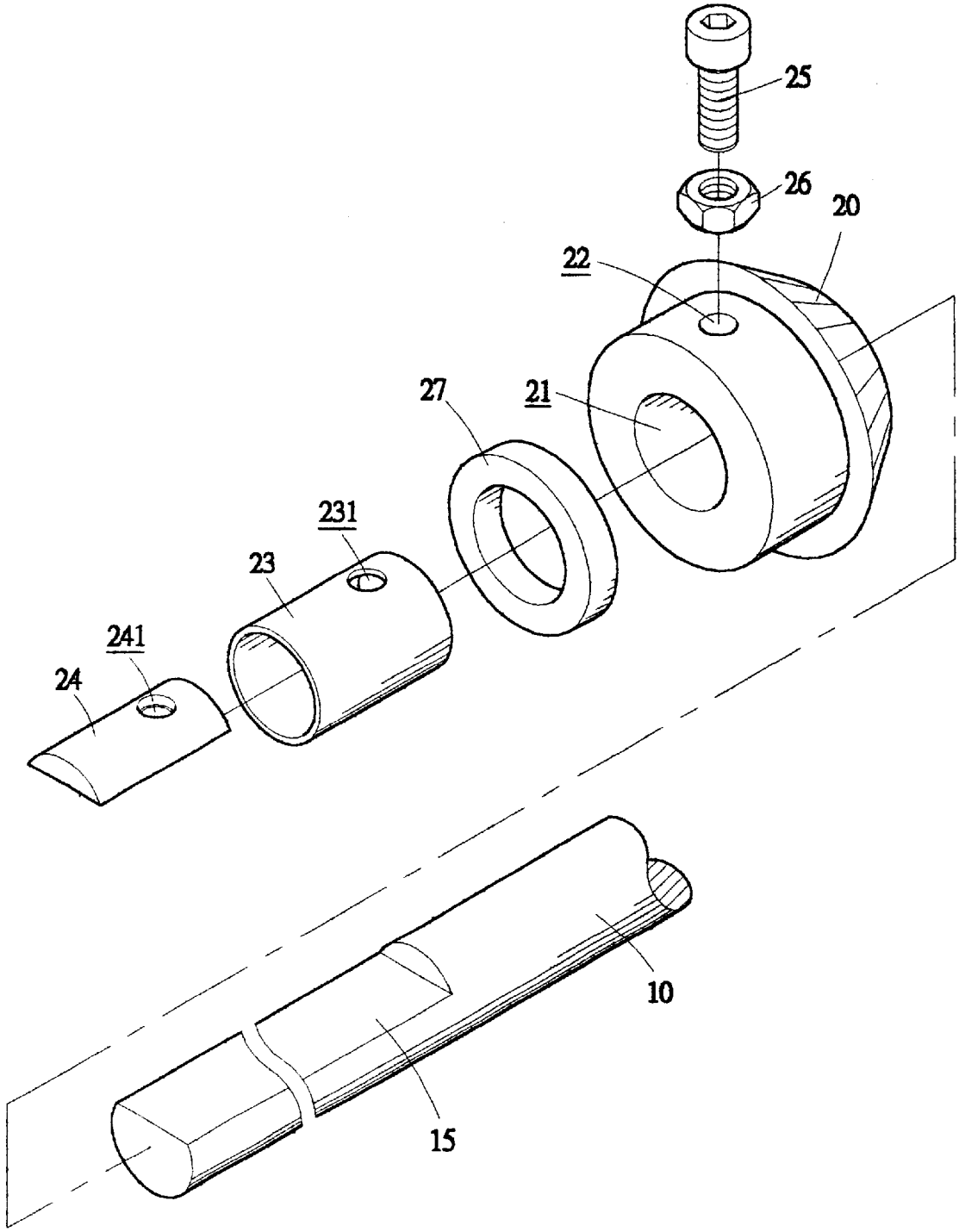
FIG. 4 is an exploded view of a driving shaft of the adjustable wrappage film feeding device of the present invention.
Figure 5:
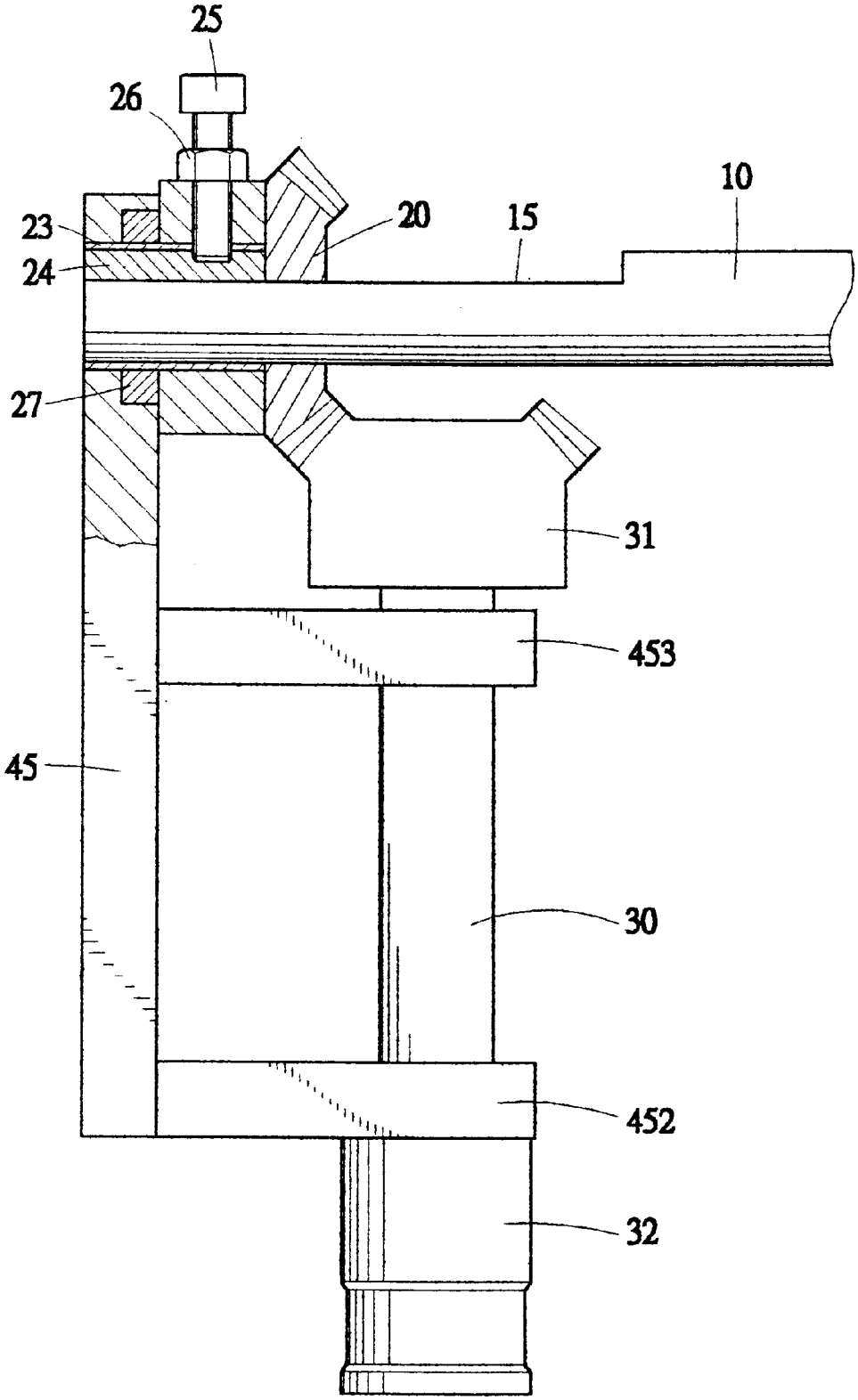
FIG. 5 is a plane view of a transmission mechanism of the adjustable wrappage film feeding device of the present invention.

Also referring to FIGS. 4 and 5, the driving shaft 10 forms a gear sliding section 15 corresponding to each driving gear 20. In a first embodiment of the present invention illustrated in FIG. 4, the gear sliding section 15 is formed by removing from a circular cross section of the driving shaft 10 a chord portion of a predetermined length which forms a flat surface along the gear sliding section 15 of the driving shaft 10.

A key member 24 having a cross section complementary to the removed chord portion of the driving shaft 10 is axially movably positioned on the flat surface of the driving shaft 10. A collar 23 is fit over both the key member 24 and the driving shaft 10. The driving gear 20 forms a central bore 21 for being fit over the collar 23. A radially-extending hole 22 is defined in the driving gear 20 for receiving a bolt 25. The bolt 25 extends through a corresponding hole 231 defined in the collar 23 and threadingly engages an inner-threaded hole 241 defined in the key member 24 for securing the key member 24 and the driving gear 20 together. Since the driving gear 20 is not secured to the driving shaft 10 itself, the driving gear 20 is allowed to move axially along the gear sliding section 15. However, due to the key member 24, the driving gear 20 is not allowed to freely rotate with respect to the driving shaft 10. The driving gear 20 is thus rotatable in unison with the driving shaft 10 due to the key member 24.

If desired, a nut 26 engaging the bolt 25 may be used to secure the bolt 25.

Ends of the driving shaft 10 extend through holes (not labeled) defined in the carriages 45 and are rotatably supported by the fixed plates 41, 42. Bearing means 27 is provided on the collar 23 for supporting rotation of the driving shaft 10 and the driving gears 20 with respect to the carriages 45.

Preferably, additional lugs 453 are provided on each carriage 45 for rotatably supporting a shaft 30' on which a secondary film driving roller 31' is mounted. Each roller 31' is corresponding to and spaced from each film driving roller 32 for more stably driving the film that is fit over the film feeding cylinder 400 toward the article to be packaged. In the embodiment illustrated, the secondary rollers 31' are not coupled to the driving device 200 or other driving sources. However, if desired, the secondary rollers 31' can be mechanically coupled to the driving device 200 or other independent driving sources.

Figure 8:
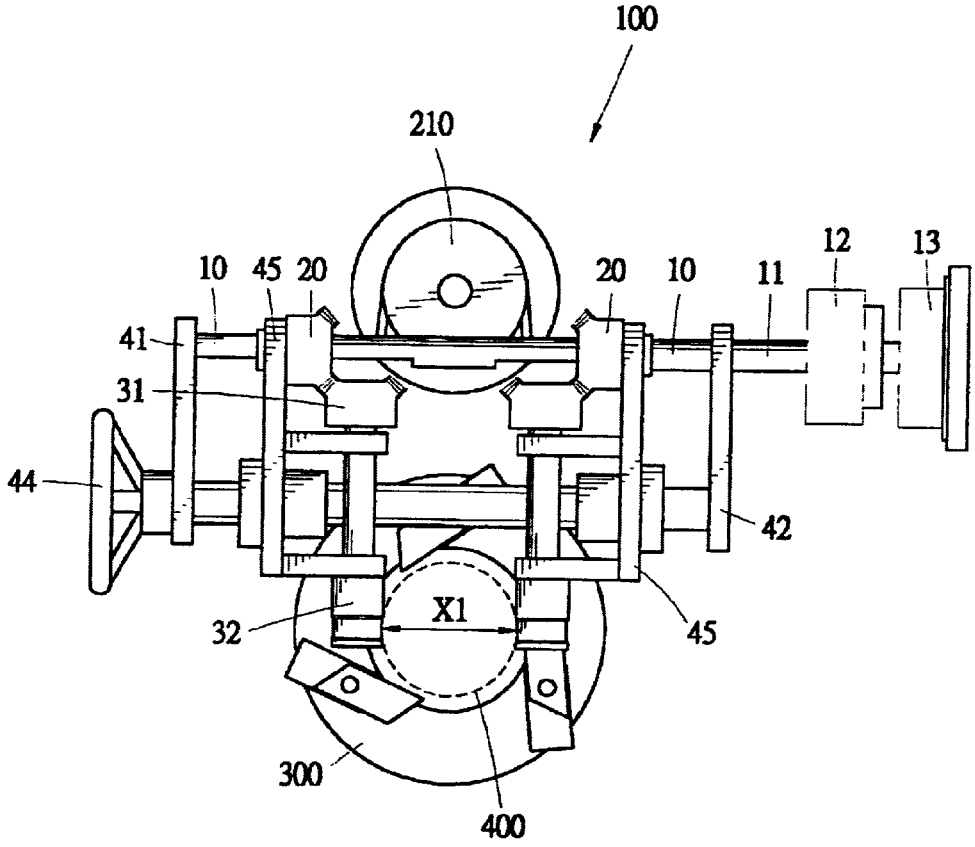
FIGS. 8 and 9 are top views showing adjustment operation of the adjustable wrappage film feeding device of the present invention.
Figure 9:
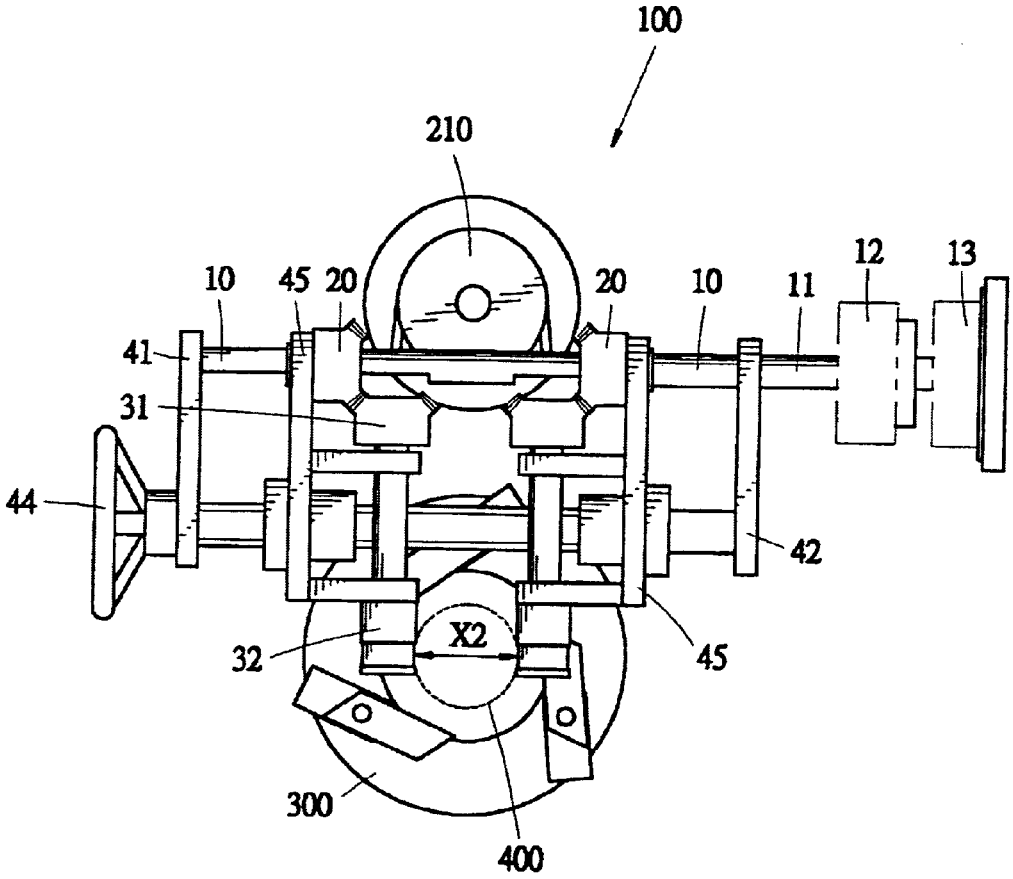

With reference to FIGS. 8 and 9, when the screw rod 43 is rotated by operating the hand wheel 44, in for example the clockwise direction, the carriages 45 are moved away from each other and the distance X1 between the rollers 32 (or rollers 31') is increased. A film feeding cylinder 400 of a large diameter can then be used. Similarly, when the hand wheel 44 drives the screw rod 43 in for example the counterclockwise direction, the carriages 45 are moved toward each other, the distance X2 between the rollers 32 (or rollers 31') is decreased and thus better suitable for a film feeding cylinder 400 having a small diameter.

Figure 6:
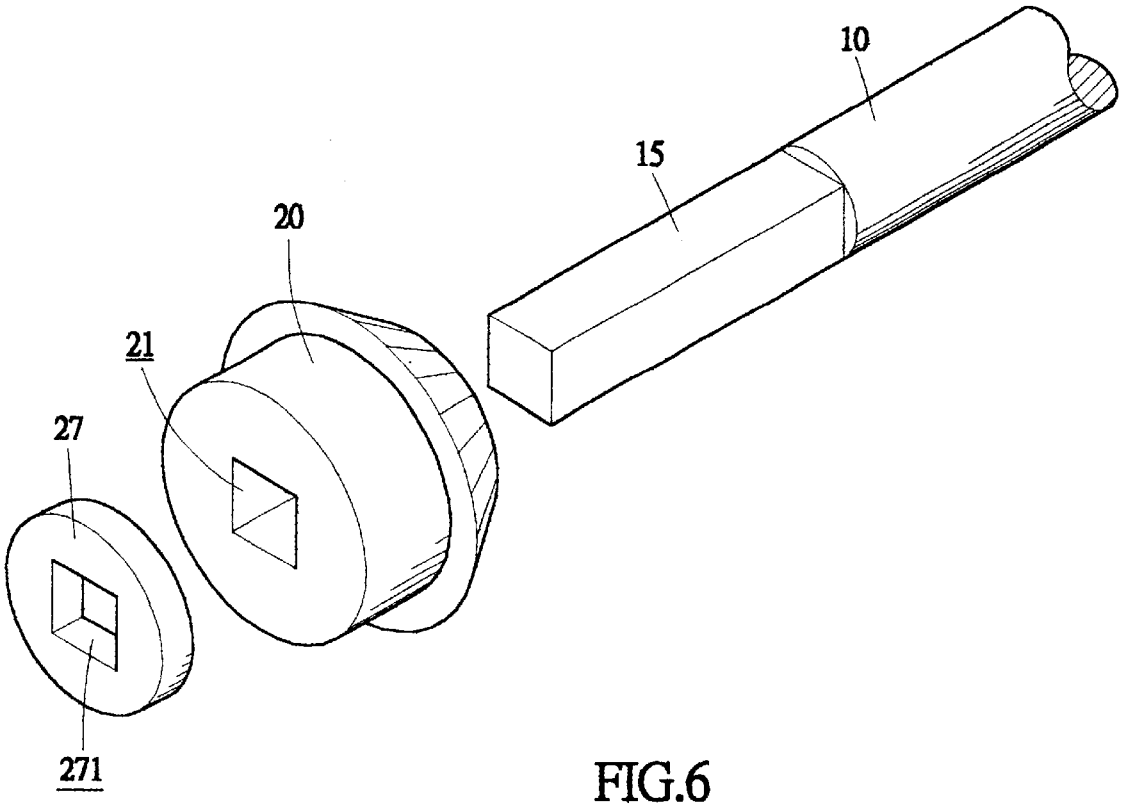
FIG. 6 is similar to FIG. 4 but showing a second embodiment of the driving shaft in accordance with the present invention.
Figure 7:
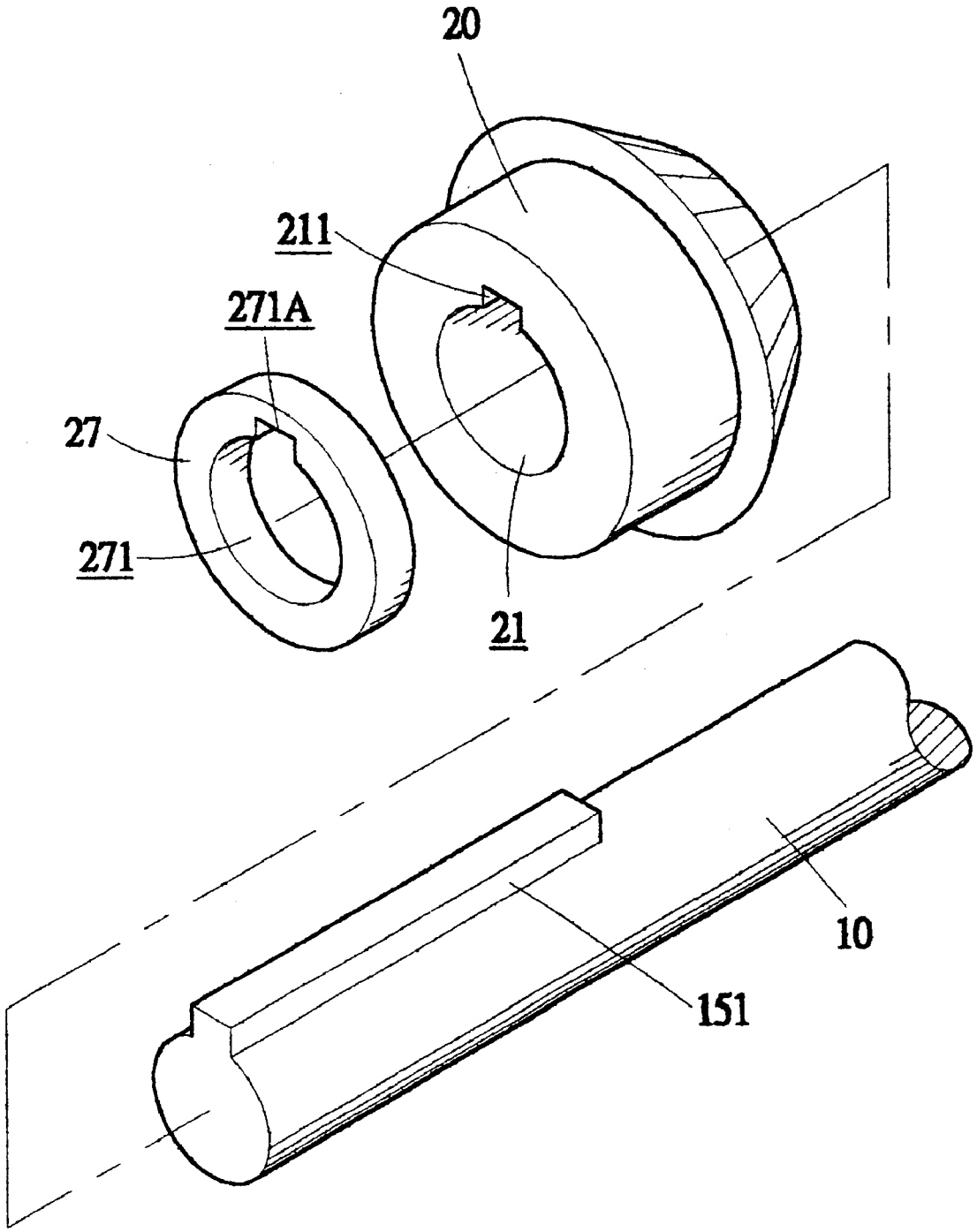
FIG. 7 is similar to FIG. 4 but showing a third embodiment of the driving shaft in accordance with the present invention.

FIGS. 6 and 7 show two different embodiments of the driving shaft 10. In the embodiment illustrated in FIG. 6, the gear sliding section 15 of the driving shaft 10 is formed with a polygonal cross section, such as rectangular or square, while the driving gear 20 defines a central bore of complementary rectangular or square shape complementary to the cross section of the driving shaft 10. A driving engagement is thus formed between the driving gear 20 and the driving shaft 10 which forces the driving gear 20 to rotate in unison with the driving shaft 10 while allowing the driving gear 20 to move in an axial direction of the driving shaft 10. The bearing means 27 also defines a central bore 271 having a shape complementary to the cross section of the driving shaft 10.

In the embodiment illustrated in FIG. 7, the driving shaft 10 forms a raised, axially-extending rib 151 in the gear sliding section, serving as a key for complementarily engaging a key way 211 defined in an inner surface of the central bore 21 of the driving gear 20. Thus a driving engagement that forces the driving gear 20 to rotate in unison with the driving shaft 10 while allowing axial movement of the driving gear 20 with respect to the driving shaft 10 is formed between the driving shaft 10 and the driving gear 20. The bearing means 27 defines a central bore 271 having a notch 271A for being fit over the keyed driving shaft 10.

Although the present invention has been described with reference to the preferred embodiments thereof, it is apparent to those skilled in the art that a variety of modifications and changes may be made without departing from the scope of the present invention. For example, the operation of the driving shaft 10 can be controlled by means other than clutch 13 illustrated above. Furthermore, the film cutting mechanism 300 can be replaced by any other known means to selectively and controllably cut off the film. All these modifications are considered within the scope of the present invention which is intended to be defined by the appended claims only.

What is claimed is:

1. An adjustable film feeding device comprising:

a driving shaft selectively coupled to a driving device by a first clutch;

two driving gears mounted to the driving shaft to be rotatable in unison with the driving shaft, axially movable means being formed between each driving gear and the driving shaft to allow axial movement of the driving gear with respect to the driving shaft;

an adjustable mechanism comprising two movable carriages spaced from each other, each carriage rotatably carrying a roller adapted to drivingly engage and convey a film in a predetermined direction, each carriage being disposed adjacent a corresponding one of the driving gears and having a bearing disposed in a respective opening for passage of the driving shaft therethrough, each roller being mechanically coupled to a corresponding one of the driving gears by a driven gear matingly engaged with the corresponding driving gear, and a screw rod threadedly engaging the carriages whereby rotation of the screw rod causes the carriages to move with respect to each other for changing a distance therebetween and thus allowing accommodation of film of different sizes, the driving gears being axially displaced with respect to the driving shall responsive to the carriages being moved by the screw rod for maintaining mating engagement between the driving gears and the corresponding driven gears; and a film cutting mechanism coupled to the driving device through a second clutch, engagement of the first and second clutches being mutually exclusive one with respect to the other.

2. The adjustable film feeding device as claimed in claim 1, wherein axially movable means of the driving gear comprises a flat surface formed on a gear sliding section of the driving shaft by removing a chord portion of the driving shaft, the driving gear defining a central bore fit over the gear sliding section, a key having a complementary cross section being positioned between the flat surface of the driving shaft and an inner surface of the central bore of the driving gear, a bolt extending through a hole defined in the driving gear and threadingly engaging an inner-threaded hole of the key member to secure the driving gear to the key member for ensuring rotation of the driving gear in unison with the driving shaft.

3. The adjustable film feeding device as claimed in claim 2, wherein a nut threadingly engages the bolt for securing the bolt.

4. The adjustable film feeding device as claimed in claim 1, wherein the axially movable means comprises a gear sliding section of the driving shaft having a polygonal cross section, the driving gear defining a central hole complementary in shape to the polygonal cross section whereby the driving gear is allowed to take axial movement while rotatable in unison with the driving shaft.

5. The adjustable film feeding device as claimed in claim 4, wherein the polygonal cross section is rectangular.

6. The adjustable film feeding device as claimed in claim 1, wherein the axially movable means comprises a raised, axially-extending rib formed on a gear sliding section of the driving gear, the driving gear defining a central bore having an inner surface in which a key way is formed for drivingly engaging the rib.

7. The adjustable film feeding device as claimed in claim 1, wherein each carriage comprises an inner-threaded portion for threading engagement with the screw rod.

8. The adjustable film feeding device as claimed in claim 1 further comprising auxiliary rollers not coupled to the driving device.

9. The adjustable film feeding device as claimed in claim 1 further comprising at least a pair of film feeding cylinders, one of the pan of film feeding cylinders being selectively disposed between the rollers, a first of the pair of film feeding cylinders having a first cross-sectional dimension and a second of the pair of film feeding cylinders having a second cross-sectional dimension, the second cross-sectional dimension being greater than the first cross-sectional dimension, the selected one of the film feeding cylinders being arranged to expand a tubular film and adapted to direct conveyance of the film toward an article to be packaged by the film, the rollers being in frictional engagement with the film for driving and conveying the film along the cylinder.

* * * * *